US006857768B2

(12) United States Patent
Watanabe et al.

(10) Patent No.: US 6,857,768 B2
(45) Date of Patent: Feb. 22, 2005

(54) VEHICLE HEADLAMP

(75) Inventors: Shigeyuki Watanabe, Shizuoka (JP); Shoichiro Yokoi, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 10/371,889

(22) Filed: Feb. 21, 2003

(65) Prior Publication Data

US 2003/0165066 A1 Sep. 4, 2003

(30) Foreign Application Priority Data

Mar. 4, 2002 (JP) ..... 2002-057850

(51) Int. Cl.[7] ..... F21V 17/02

(52) U.S. Cl. ..... 362/512; 362/284; 362/324; 362/467; 362/539

(58) Field of Search ..... 362/512, 513, 362/282, 284, 322, 324, 466, 467, 538, 539

(56) References Cited

U.S. PATENT DOCUMENTS 4,616,298 A * 10/1986 Bolson ..... 362/192
5,158,352 A * 10/1992 Ikegami et al. ..... 362/539
5,343,371 A 8/1994 Kobayashi et al.
5,373,424 A 12/1994 Ishikawa
5,379,196 A 1/1995 Kobayashi et al.
5,645,338 A 7/1997 Kobayashi
6,286,985 B1 9/2001 Ohshio et al.
6,425,683 B1 * 7/2002 Kusagaya et al. ..... 362/512
6,428,195 B1 8/2002 Ohshio et al.
6,443,606 B1 9/2002 Mochizuki
2001/0028566 A1 * 10/2001 Ohshio ..... 362/512

FOREIGN PATENT DOCUMENTS

JP 2001-110213 4/2001

* cited by examiner

*Primary Examiner*—Sandra O'Shea
*Assistant Examiner*—Mark Tsidulko
(74) *Attorney, Agent, or Firm*—Fish & Richardson P.C.

(57) ABSTRACT

In a projector-type lamp unit, a shade is pivotally supported on a holder provided between a reflector and a projection lens. This support is provided at a plurality of regions disposed on an axis Ax1 of pivotal movement of the shade. This support at the plurality of regions is effected through a single shaft extending in a direction of the pivotal movement axis.

11 Claims, 6 Drawing Sheets

LOW BEAM

HIGH BEAM

VEHICLE HEADLAMP

BACKGROUND OF THE INVENTION

1. Field of the Invention

This invention relates to a vehicle headlamp having a so-called projector-type lamp unit and to a vehicle headlamp having a lamp unit provided with a movable shade.

2. Description of the Related Art

A projector-type lamp unit is of such a construction that light from a light source, located on an optical axis extending in a forward-rearward direction of a vehicle, is reflected forwardly toward the optical axis. This reflected light is radiated to a zone ahead of a lamp unit through a projection lens provided forwardly of the reflector.

JP-A-2001-110213 discloses a projector-type lamp unit in which a shade, which can intercept a part of reflected light from a reflector, is provided between a projection lens and the reflector. This shade can be pivotally moved between two predetermined positions, at which the amount of interception of the reflected light are respectively different, to switch the beam between a low-beam mode and a high-beam mode.

In the lamp unit disclosed in the above publication, the shade is pivotally supported on a holder provided between the projection lens and the reflector. This shade, when viewed from the top, curves into a generally arcuate shape, with its opposite (right and left) end portions curved toward the front side. The shade is mounted on the holder by pivot pins provided respectively at those portions of its opposite right and left end portions disposed near its upper edge.

In the lamp unit disclosed in the above publication, however, the shade on the holder is mounted at two separate regions. Therefore, the mounting operation is cumbersome, and the efficiency of the operation is low. Furthermore, it is not easy to mount the shades precisely to obtain accurate pivotal movements.

SUMMARY OF THE INVENTION

An object of the invention is to provide a vehicle headlamp having a projector-type lamp unit provided with a movable shade, in which the shade can be easily and precisely mounted on a holder.

This invention provides a suitable structure for supporting a shade by a holder.

Namely, the present invention provides a vehicle headlamp including a projector-type lamp unit which comprises a light source, disposed on an optical axis extending in a forward-rearward direction of a vehicle, a reflector for forwardly reflecting light from the light source toward the optical axis, a projection lens, provided forwardly of the reflector, a holder, which is provided between the projection lens and the reflector, and supports the projection lens and the reflector, a shade, which is pivotally supported on the holder, and can intercept part of reflected light from the reflector, and an actuator for pivotally moving the shade between two predetermined positions at which the amount of intercepted light is respectively different The support of the shade on the holder is provided at a plurality of regions disposed on an axis of pivotal movement of the shade. The support at the plurality of regions is effected through a single shaft extending in a direction of the pivotal movement axis.

The above "light source" is not particularly limited to any specific kind, and can include, for example, a discharge light-emitting portion of a discharge bulb, and a filament of an incandescent bulb such as a halogen bulb.

The above "two predetermined positions providing different degrees of interception of the reflected light" may form a low-beam luminous distribution pattern and a high-beam luminous distribution pattern, respectively, by the use of the movable shade, or may assume other luminous distribution patterns.

The specific construction of the above "actuator" is not particularly limited so long as it can pivotally move the shade between the two predetermined positions. For example, a solenoid, a stepping motor, a hydraulic cylinder or the like can be used.

The above expression "the support of the shade on the holder is provided at a plurality of regions disposed on an axis of pivotal movement of the shade" means that the shade is supported on the holder so that a plurality of portions of the shade are opposed respectively to a plurality of portions of the holder in the direction of the pivotal movement axis.

The direction of extension of the above "pivotal movement axis" is not particularly limited so long as it is not parallel to the optical axis.

The above "shaft" is fixed to the shade or the holder, and its method of fixing is not particularly limited. For example, the method can include screw fastening, welding, or press-fitting As described above, the vehicle headlamp of the present invention has the projector-type lamp unit. The shade is pivotally supported on the holder of this lamp unit, and this support is provided at the plurality of regions disposed on the axis of pivotal movement of the shade. This support at the plurality of regions is effected through the single shaft extending in the direction of the pivotal movement axis. Therefore, the mounting of the shade on the holder can be carried out in a single process.

Therefore, compared to the conventional construction in which the shade is supported on the holder at a plurality of regions, disposed on the axis of pivotal movement of the shade, through the individual pivot pins, the shade can be more easily mounted on the holder. Furthermore, this mounting operation can be provided precisely so that accurate pivotal movements can be realized.

Thus, in the vehicle headlamp of the invention including the projector-type lamp unit having the movable shade, the shade can be mounted on the holder easily and precisely.

The method of fixing the above "shaft" to the shade or the holder is not particularly limited to the description above. The mounting of the shade on the holder can be quite easily accomplished by fixedly press-fitting the shaft into the holder or the shade.

In the above construction, the upstanding wall portion can be formed at that portion of the holder disposed forwardly of and near the shade. With this construction, the direct light from the light source and the reflected light from the reflector can be intercepted not only by the shade but also by the upstanding wall portion. Therefore, at those regions where the direct light and the reflected light are intercepted by the upstanding wall portion, the light by the shade does not need to be intercepted. Therefore, the shade can be reduced in weight by cutting unnecessary portions thereof, so that the shade can be pivotally moved with a small driving force. The above "upstanding wall portion" is not particularly limited to any specific shape. For example, this upstanding wall portion can be formed to extend generally in facing relation to the shade. Here, the expression "part of the direct light from the light source and the reflected light from the reflector" means only part of the direct light from the light source, only part of the reflected light from the reflector, or part of the direct light from the light source and part of the reflected light from the reflector.

Preferably, projections are formed on the upstanding wall portion, and when the shade is moved into each of the predetermined positions, the shade abuts against the corresponding projection. With this construction, the shade can be accurately located in each of the predetermined positions. Therefore, each luminous distribution pattern, formed by the light radiating from the lamp unit, is effectively prevented from deviating, which can arise because of, for example, vibrations of the vehicle. Furthermore, an undue force is prevented from acting on the actuator.

In the above construction, preferably, the actuator is fixedly supported on the holder. With this construction the precision of the position between the actuator and the shade can be enhanced to smoothly drive the shade by the actuator.

Generally, in the vehicle headlamp, the lamp unit is received within a lamp chamber formed by a light-transmitting cover and a lamp body. Therefore, preferably, brackets, through which the lamp unit is mounted on the lamp body, are formed on the holder. By doing this, the strength of support of the lamp unit can be easily increased.

DETAILED DESCRIPTION OF THE PREFERRED EMBODIMENTS

A preferred embodiment of the present invention will now be described with reference to the drawings.

Figure 1:
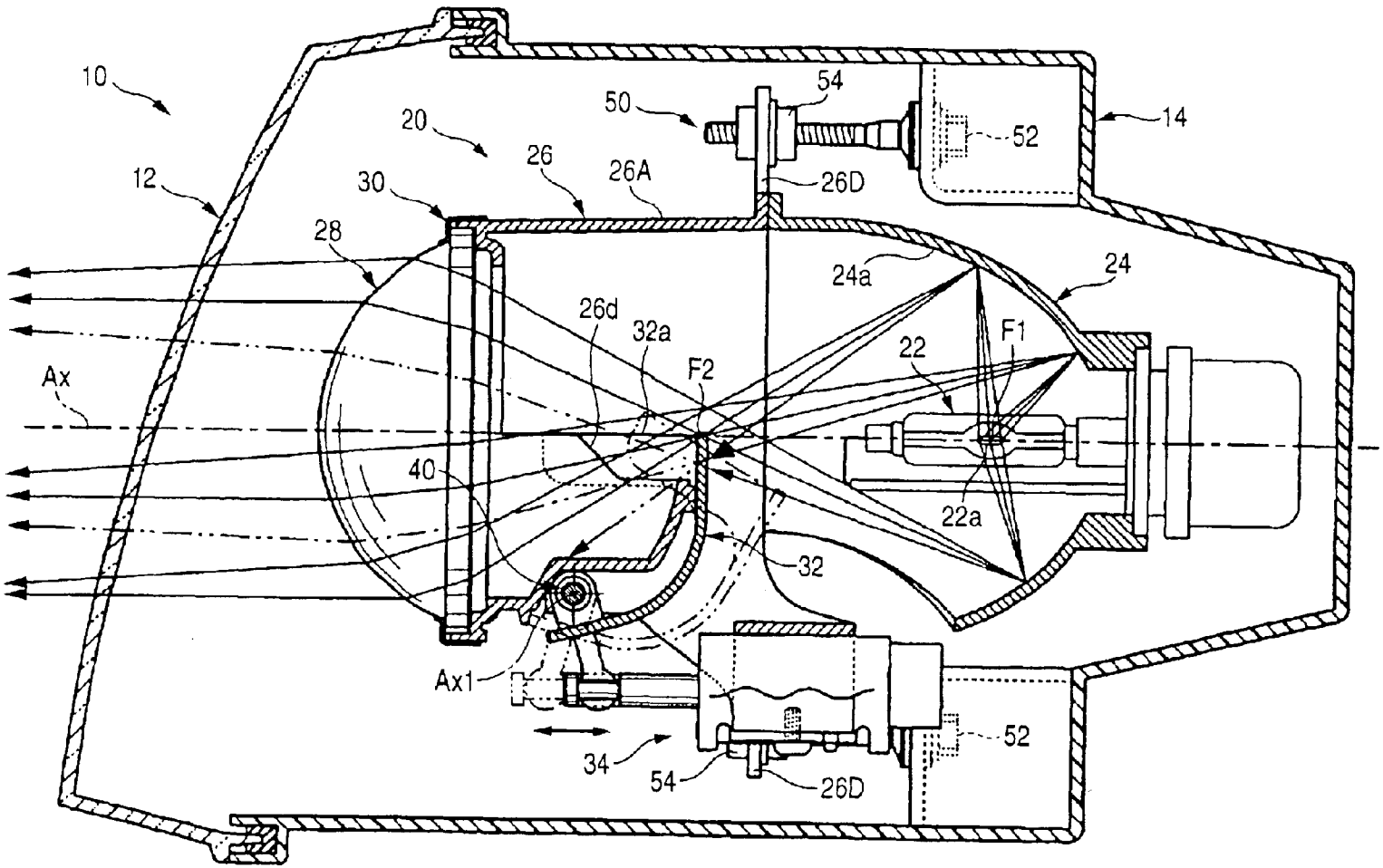
FIG. 1 is a side cross-sectional view showing one embodiment of a vehicle headlamp of the present invention.

FIG. 1 is a side cross-sectional view showing one embodiment of a vehicle headlamp of the present invention.

As shown in the drawings, this vehicle lamp unit 10 includes a lamp unit 20 which is received within a lamp chamber formed by a transparent light-transmitting cover 12 and a lamp body 14. This lamp unit 20 is supported on the lamp body 14 through an aiming mechanism 50 to tilt in right and left directions and also in upward and downward directions.

Figure 2:
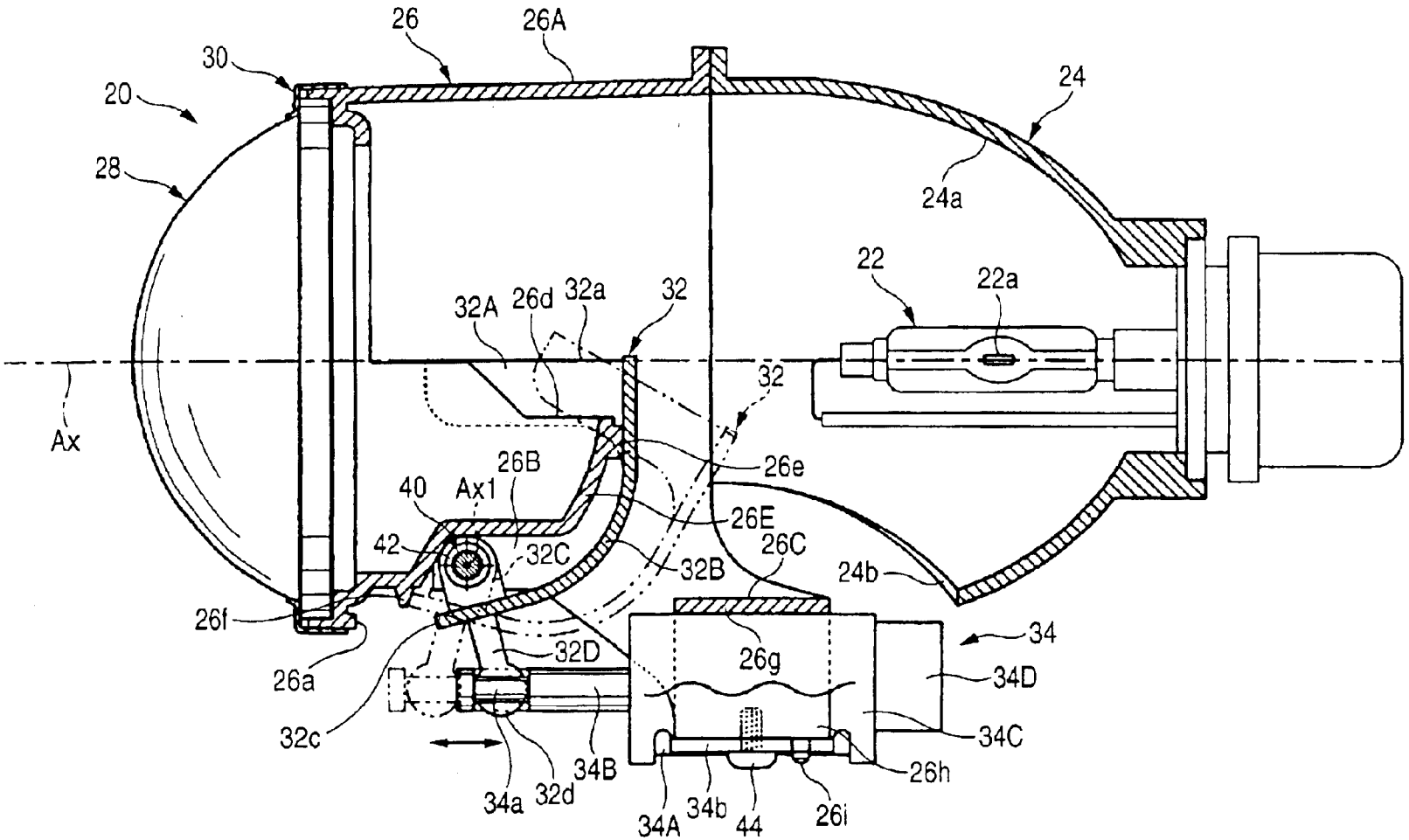
FIG. 2 is a side cross-sectional view showing a lamp unit of the vehicle headlamp alone.
Figure 3:
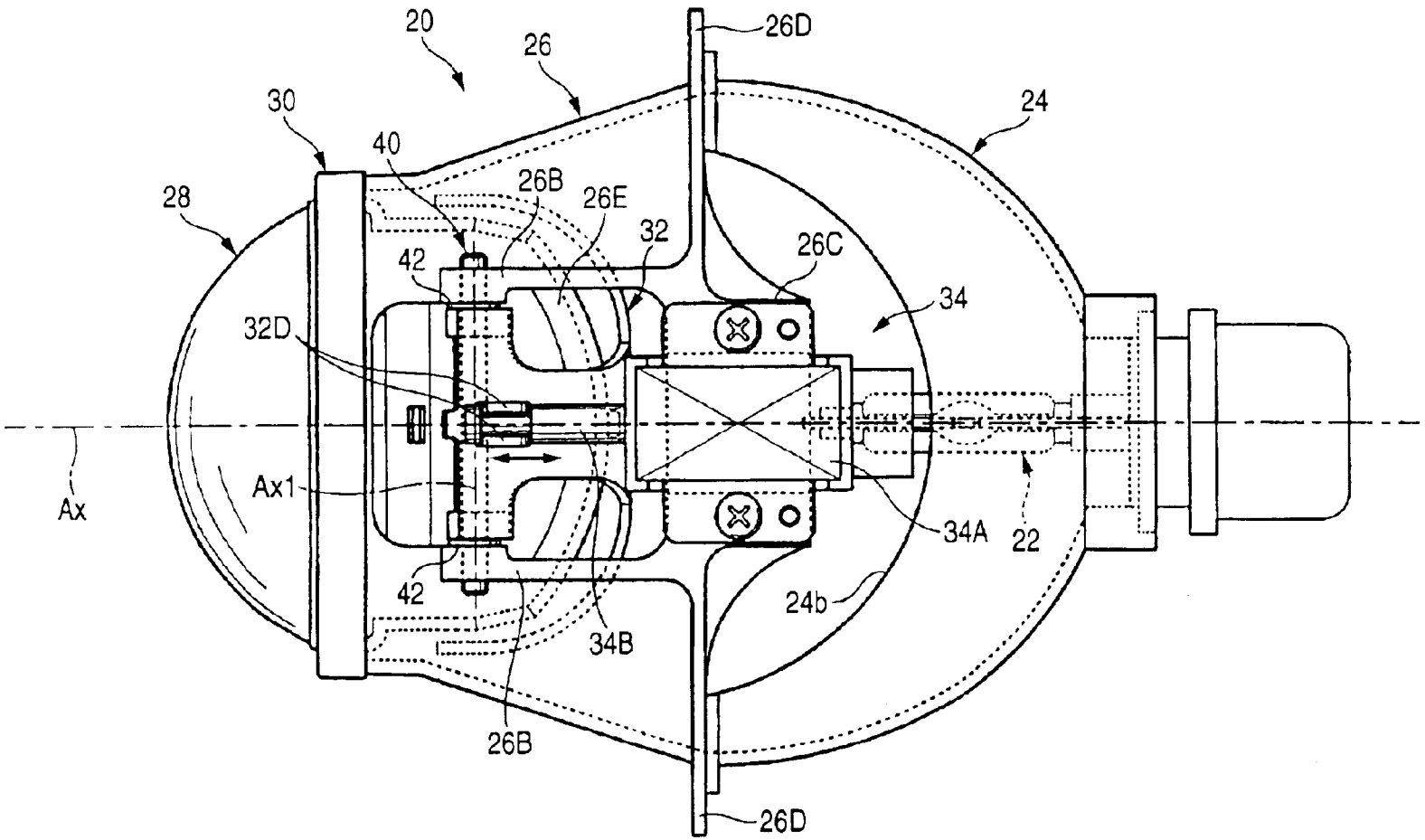
FIG. 3 is a bottom view of the lamp unit alone.
Figure 4:
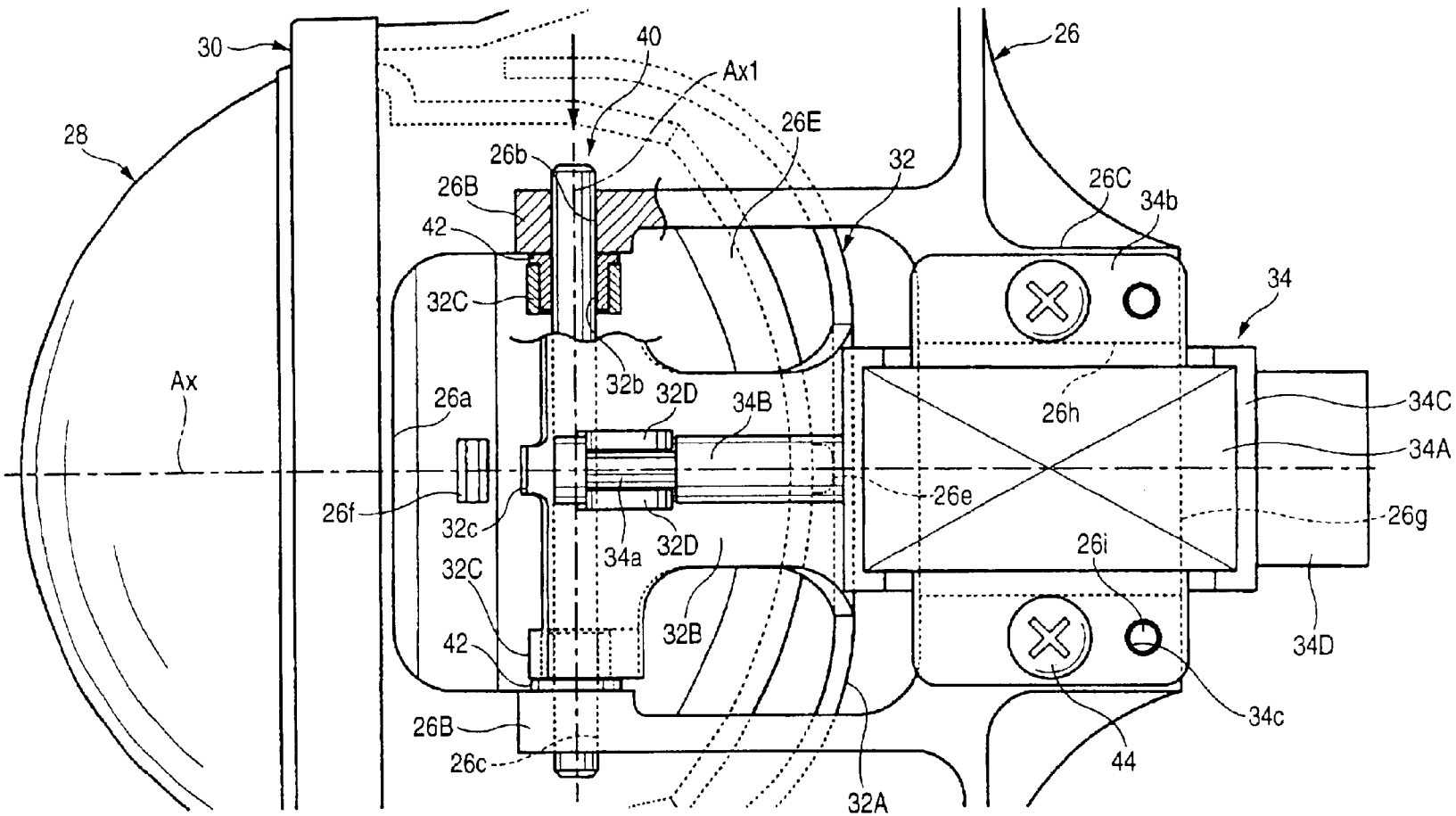
FIG. 4 is a detailed view of a portion of FIG. 3.
Figure 5:
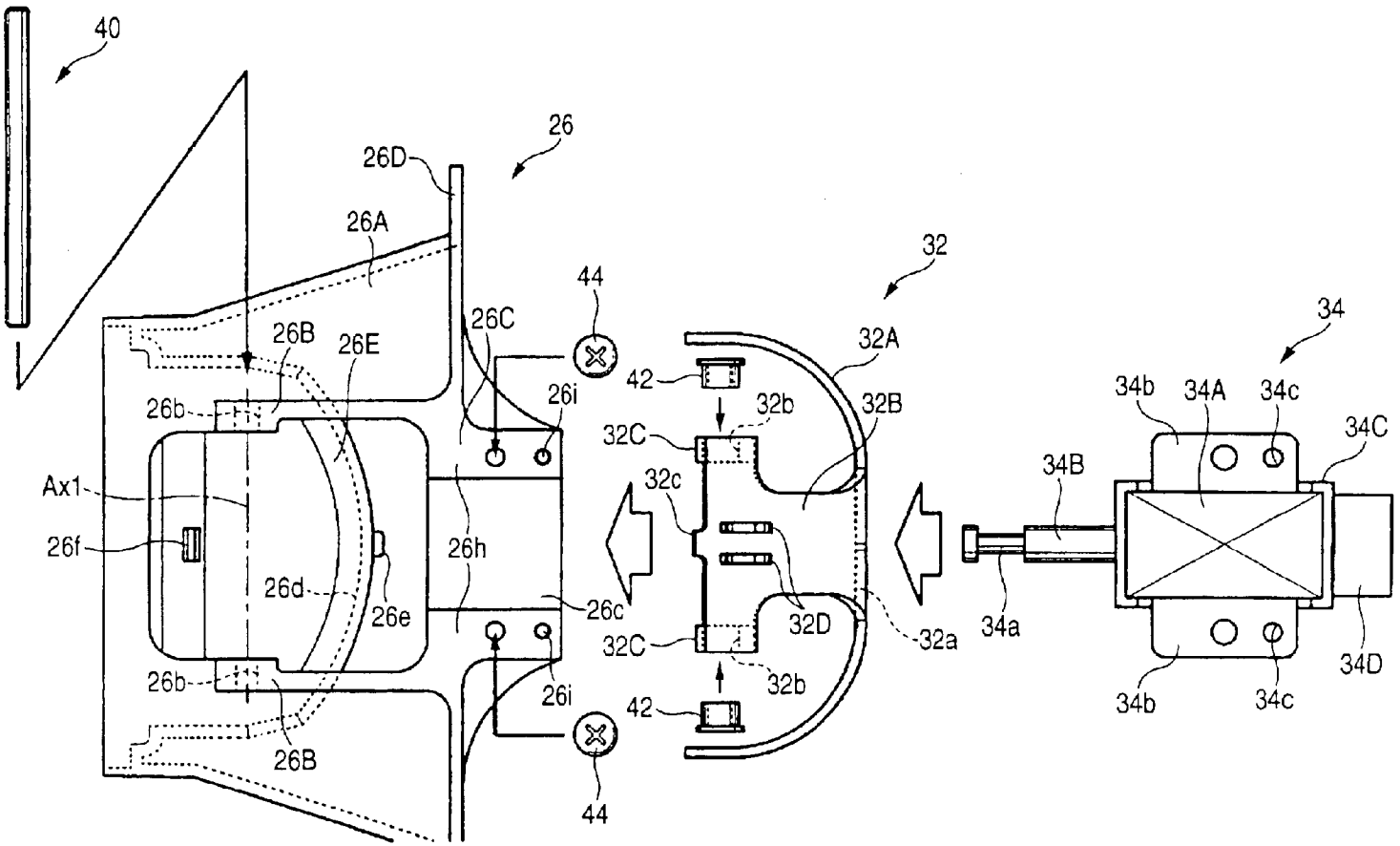
FIG. 5 is a bottom view showing elements of the lamp unit in a disassembled condition.

FIG. 2 is a side cross-sectional view showing the lamp unit 20 alone, FIG. 3 is a bottom view thereof, FIG. 4 is a detailed view of an important portion of FIG. 3, and FIG. 5 is a bottom view showing elements of the lamp unit 20 in a disassembled condition.

As shown also in these Figures, the lamp unit 20 is a projector-type lamp unit and includes a discharge bulb 22, a reflector 24, a holder 26, a projection lens 28, a retaining ring 30, a shade 32, and an actuator 34.

The discharge bulb 22 is a metal halide bulb, and is mounted on the reflector 24 so that an axis of a discharge light-emitting portion 22*a* (light source) thereof coincides with an optical axis Ax extending in a forward-rearward direction of a vehicle.

The reflector 24 has a reflecting surface 24*a* of a generally ellipsoidal shape having a center axis coinciding with the optical axis Ax. A cross-sectional shape of this reflecting surface 24, including the optical axis Ax, is elliptical, and its eccentricity gradually increases from a vertical cross-section to a horizontal cross-section. However, rear apexes of the ellipses, respectively forming these cross-sections, are disposed at the same position. The light source 22*a* is located at a first focus F1 of the ellipse forming the vertical cross-section of this reflecting surface 24*a*. With this arrangement, the reflecting surface 24 a reflects light from the light source 22 a forwardly toward the optical axis Ax. The reflecting surface 24 a generally converges the light on a second focus F2 of the above ellipse in the vertical cross-section including the optical axis Ax. An arcuate notch 24*b* is formed in a lower end portion of an open front end of the reflector 24.

The holder 26 is a die-cast product and is provided between the reflector 24 and the projection lens 28.

The holder 26 includes a tubular portion 26A slightly narrowing gradually toward a front end thereof from the open front end of the reflector 24, a pair of right and left shaft support portions 26B extending downwardly from a lower end of the tubular portion 26A, an actuator support portion 26C extending rearwardly, obliquely, and downwardly from the shaft support portions 26B, a plurality of unit-mounting brackets 26D projecting outwardly respectively from predetermined portions of a rear end of the tubular portion 26A, and an upstanding wall portion 26E extending in a curved manner from a lower half portion of the front end portion of the tubular portion 26A into an internal space of the tubular portion 26A. An opening 26*a* is formed in that portion of the lower end portion of the tubular portion 26A disposed between the two shaft support portions 26B.

The holder 26 fixedly supports the projection lens 28 at the front end of the tubular portion 26A through the retaining ring 30 and fixedly supports the reflector 24 at the rear end of the tubular portion 26A. The unit-mounting brackets 26D of the holder 26 are engaged respectively with aiming screws 52 of the aiming mechanism 50 through respective aiming nuts 54, and with this construction the lamp unit 20 is mounted on the lamp body 14.

The projection lens 28 is a plano-convex lens having a front convex surface and a rear plane surface. This projection lens 28 is located so that its rear focus coincides with the second focus F2 of the reflector 24. With this arrangement, the projection lens 28 transmits the reflected light from the reflecting surface 24*a* of the reflector 24 to deflect it toward the optical axis Ax.

The shade 32 is disposed in a generally lower half portion of the internal space of the tubular portion 26A of the holder 26, and is supported on the holder 26 to pivotally move about a pivotal movement axis Ax1 extending in a right-left direction. The shade 32 is pivotally movable between a light-interception position, indicated in solid lines in FIGS. 1 and 2, and an light-interception cancellation position indicated in dots-and-dash lines.

Figure 6A:
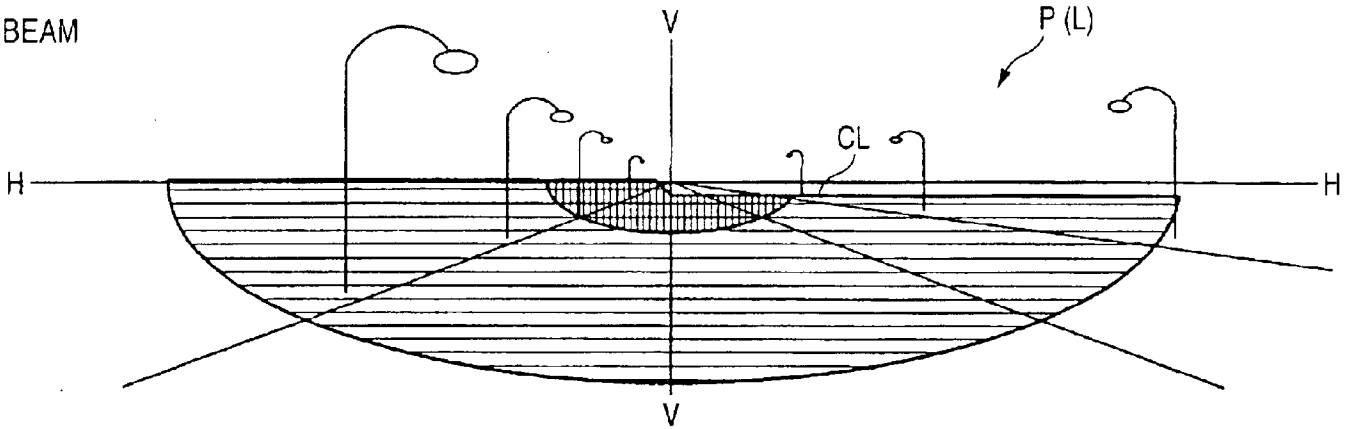
FIGS. 6A and 6B are illustrations showing luminous distribution patterns each formed on an imaginary vertical screen, forwardly spaced from the lamp, by a beam radiating from the lamp unit.

A right-half portion of an upper edge 32*a* of the shade 32, disposed on the right side of the optical axis Ax, is horizontally disposed at the same level as the optical axis Ax. While a left-half portion of the upper edge 32*a*, disposed on the left side of the optical axis Ax, is horizontally disposed at a level slightly higher than the optical axis Ax. Therefore, the upper edge 32*a* is stepped. When the shade 32 is located in the light-interception position, the stepped portion of the upper edge 32*a* is disposed to pass through the second focus F2. Therefore, the shade intercepts part of the reflected light from the reflecting surface 24*a*, thereby eliminating upwardly-directed radiation light which goes out of the lamp unit 20. Thus, a low beam (indicated in solid lines in FIG. 1), radiating downwardly relative to the optical axis Ax, is obtained. As a result, a low-beam luminous distribution pattern P(L) is formed, having a right-left stepped (so-called Z-type) cut-off line CL with a higher left-side intensity, as shown in FIG. 6A.

Figure 6B:
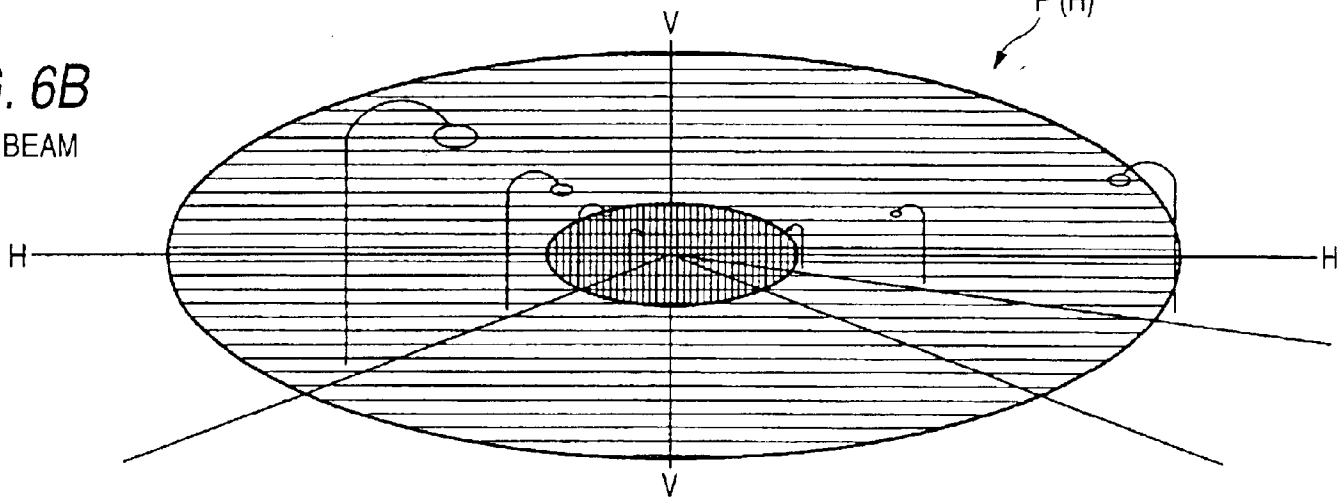

On the other hand, when the shade 32 is located in the light-interception cancellation position, the shade 32 cancels the interception of the reflected light from the reflecting surface 24*a* and allows upwardly-directed radiation light (indicated in dots-and-dash lines in FIG. 1) to go out of the lamp unit 20, so that a high beam is obtained. As a result, a high-beam luminous distribution pattern P(H) is formed as shown in FIG. 6B.

The shade 32 is a die-cast product, and includes an arcuate vertical portion 32A, a central stay portion 32B, a pair of shaft engagement brackets 32C, and a pair of right and left plunger engagement brackets 32D. The arcuate vertical portion 32A curves into a generally arcuate shape, with its opposite (right and left) end portions curved toward the front side. The central stay portion 32B extends downwardly from a central portion of the arcuate vertical portion 32A and is curved, with a lower end thereof directed toward the front side. The pair of shaft engagement brackets 32C is formed respectively on upper surfaces of opposite (right and left) side portions of a front end portion of the central stay portion 32B. The pair of right and left plunger engagement brackets 32D is formed on a lower surface of a central portion of the front end portion of the central stay portion 32B.

The shade 32 is supported on the holder 26 at two regions disposed on the pivotal movement axis Ax1. This support at the two regions is provided through a single shaft 40, extending in the direction of the pivotal movement axis Ax1, in the following manner.

A shaft passage hole 26*b*, having an inner diameter generally equal to the outer diameter of the shaft 40, is formed through one of the pair of right and left shaft support portions 26B. A shaft press-fitting hole 26*c*, having an inner diameter slightly smaller than the outer diameter of the shaft 40, is formed through the other shaft support portion 26B.

On the other hand, a through hole 32*b* is formed through each of the shaft engagement brackets 32C of the shade 32, and extends in the right-left direction. A bushing (made of metal) 42 is press-fitted into each through hole 32*b* from the outside (right or left side), and is fixed thereto. Each of these bushings 42 serves as a flanged sleeve having an inner diameter slightly larger than the outer diameter of the shaft 40.

The two shaft engagement brackets 32C, each having the bushing 42 fixedly press-fitted therein, are located between the two shaft support portions 26B of the holder 26. Bores of the bushings 42 are aligned respectively with the shaft passage hole 26*b* and shaft press-fitting holes 26*c* formed respectively in the two shaft support portions 26B. In this condition, the shaft 40 is inserted into the shaft passage hole 26*b*, and is passed through this hole 26*b* and the two bushings 42 along the pivotal movement axis Ax1, and then is press-fitted into the shaft press-fitting hole 26*c*, and is fixed thereto. By this, the shade 32 is pivotally supported on the holder 26.

The upstanding wall portion 26E of the holder 26 is formed such that when the shade 32 is located in the light-interception position, this upstanding wall portion 26E extends generally to face the shade 32. Opposite (right and left) end portions of an upper edge 26*d* of the upstanding wall portion 26E are disposed generally at the same level as the upper edge 32*a* of the shade 32. While, a central portion of the upper edge 26*d* is disposed at a level lower than the upper edge 32*a* of the shade 32. The vertical width of the arcuate vertical portion 32A of the shade 32 is slightly larger than the difference in height between the central portion of the upper edge 26*d* of the upstanding wall portion 26E and opposite (right and left) end portions of the upper edge 26*d*.

A projection 26*e* is formed on a central portion of the rear surface of the upstanding wall portion 26E, and is provided adjacent to the upper edge thereof. When the shade 32 is pivotally moved from the light-interception cancellation position to the light-interception position, this projection 26*e* abuts against the shade 32. A projection 26*f* is formed on a central portion of the lower surface of the upstanding wall portion 26E, and is provided adjacent to the front end thereof. When the shade 32 is pivotally moved from the light-interception position to the light-interception cancellation position, this projection 26*f* abuts against the shade 32. On the other hand, a projection 32*c* for engaging with the projection 26*f* of the upstanding wall portion 26E is formed at a central portion of the front end of the central stay portion 32B of the shade 32.

Each of the pair of right and left plunger engagement brackets 32D, formed on the central stay portion 32B of the shade 32, has an arcuate distal end portion 32*d* of a larger size. The shade 32 engages with the actuator 34 at these arcuate distal end portions 32*d*.

The actuator 34 includes a return spring-containing-type solenoid.

More specifically, the actuator 34 includes a solenoid body 34A containing a return spring, a plunger 34B projecting forwardly from the solenoid body 34A, a body housing 34C receiving the solenoid body 34A therein, and a connector 34D mounted on a rear end of the body housing 34C. The actuator 34 is fixedly supported by the actuator support portion 26C of the holder 26 so that the plunger 34B is engaged with the pair of plunger engagement brackets 32D of the shade 32. The plunger 34B has a smaller-diameter portion 34*a* formed adjacent to a distal end thereof. The arcuate distal end portions 32*d* of the two plunger engagement brackets 32D are engaged with the smaller-diameter portion 34*a*.

In response to a switching operation of a beam-changing switch (not shown), the actuator 34 pivotally moves the shade 32 between the light-interception position and the light-interception cancellation position, thereby switching the beam between the low-beam mode and the high-beam mode. When the actuator 34 is de-energized, the plunger 34B is moved rearward by a resilient force of a return spring contained in the body housing 34C, thereby holding the shade 32 in the light-interception position.

For mounting the actuator 34 on the holder 26, an upper surface of the body housing 34C is abutted against an upper wall portion 26*g* of the actuator support portion 26C. A pair of right and left flange portions 34*b*, formed respectively on opposite side surfaces of the body housing 34C, are abutted respectively against lower surfaces of opposite side wall portions 26*h* of the actuator support portion 26C. In this condition, each flange portion 34*b* is fixedly secured to the corresponding side wall portion 26*h* by a screw 44. In order to position the body housing 34C and the holder 26 relative to each other, a positioning pin 26*i* is formed on the lower surface of each side wall portion 26*h* while a positioning hole 34*c* for receiving the positioning pin 26*i* is formed in each flange portion 34*b*.

Next, an example of how this invention operates will be described.

The vehicle headlamp 10 of this embodiment has the projector-type lamp unit 20. The shade 32 is pivotally supported on the holder 26 of this lamp unit 20. This support is provided at the plurality of (two) regions disposed on the axis Ax1 of pivotal movement of the shade 32, and this support at the plurality of regions is effected through the single shaft 40 extending in the direction of the pivotal movement axis Ax1. Therefore, the mounting of the shade 32 on the holder 26 can be carried out in a single process.

Therefore, as compared with the conventional construction in which the shade is supported on the holder at the plurality of regions, disposed on the axis of pivotal movement of the shade, through the individual pivot pins, the shade 32 can be more easily mounted on the holder 26. Furthermore, this mounting operation can be provided precisely so that the accurate pivotal movement axis can be obtained.

Moreover, in this embodiment, the shaft 40 is press-fitted into and fixed to the shaft press-fitting hole 26*c* in the shaft support portion 26B of the holder 26, and therefore the mounting of the shade 32 on the holder 26 can be carried out quite easily.

In this embodiment, the upstanding wall portion 26E is curved at that portion of the holder 26, disposed forwardly of and near to the shade 32, so that this upstanding wall portion 26E extends generally faces the shade 32 located in the light-interception position. Therefore, the reflected light from the reflector 24 can be intercepted not only by the shade 32 but also by the upstanding wall portion 96E. Therefore, at those regions where the reflected light is intercepted by the upstanding wall portion 26E, the reflected light by the shade need not be intercepted. Therefore, the shade 32 can be reduced in weight by cutting unnecessary portions thereof.

In this embodiment, the opposite (right and left) end portions of the upper edge 26*d* of the upstanding wall portion 26E is disposed generally at the same level as the upper edge 32*a* of the shade 32, while the central portion of the upper edge 26*d* is disposed at the level lower than the upper edge 32*a* of the shade 32 by a certain amount. Therefore, when the shade 32 is located in the light-interception position, the upper edge 26*d* of the upstanding wall portion 26E extends forwardly beyond the right and left ends of the upper edge 32*a* of the shade 32. When the shade 32 is located in the light-interception cancellation position, the reflected light (now free from interception by the shade) from the reflecting surface 24*a* of the reflector 24 will not be intercepted by the upstanding wall portion 26E.

The vertical width of the arcuate vertical portion 32A of the shade 32 is slightly larger than the difference in height between the central portion of the upper edge 26*d* of the upstanding wall portion 26E and the opposite (right and left) end portions of the upper edge 26*d*. Therefore, when the shade 32 is located in the light-interception position, a gap, allowing the leakage of the reflected light from the reflecting surface 24*a* therethrough, will not form between the arcuate vertical portion 32A and the upstanding wall portion 26E. Furthermore, the lightweight design of the shade 32 can be achieved, and therefore the shade 32 can be pivotally moved with a small driving force.

The upstanding wall portion 26E can also intercept part of the direct light from the light source 22*a* Therefore, the shade 32 can be reduced in weight by cutting unnecessary portions thereof.

In this embodiment, the projection 26*e* for abutting against the shade 32 in the light-interception position is formed on the upstanding wall portion 26E. Also, the projection 26*f* for abutting against the shade 32 in the light-interception cancellation position is formed on the upstanding wall portion 26E. Therefore, the shade 32 can be accurately located in the light-interception position and the light-interception cancellation position. With this construction, the low-beam luminous distribution pattern P(L) or the high-beam luminous distribution pattern P(H), formed by the light radiating from the lamp unit 20, is effectively prevented from deviating due to vibrations of the vehicle or by others reasons (for example, the cut-off line CL of the low-beam luminous distribution pattern P(L) is effectively prevented from deviating). Furthermore, an undue force is prevented from acting on the actuator 34.

In this embodiment, the actuator 34 is fixedly supported on the holder. Therefore, the precision of the position between the actuator 34 and the shade 32 can be enhanced, so that the shade 32 can be driven more smoothly by the actuator 34.

In this embodiment, all of the members, forming the lamp unit 20, except the holder 26, are supported on the holder 26, and the lamp unit 20 is mounted on the lamp body 14 through the unit-mounting brackets 26D formed on the holder 26. Therefore, the strength of support of the lamp unit 20 can be easily increased.

In this embodiment, the bushings 42 are press-fitted respectively into the through holes 32*b* formed respectively through the shaft engagement brackets 32C of the shade 32. Therefore, the diameter of the hole can be obtained with greater accuracy as compared with where a shaft passage hole for the passage of the shaft 40 therethrough is directly formed through each shaft engagement bracket 32C. Thus, by passing the shaft 40 through each bushing 42 fixedly press-fitted in the through hole 32*b* in the shaft engagement bracket 32C, the shade 32 can be pivotally moved so that the shade 32 is hardly shaken. However, if a shaft passage hole can be formed through each shaft engagement bracket 32C with a required precision, the use of the bushings 42 can be omitted.

In this embodiment, the shaft 40 is press-fitted into and fixed to the shaft press-fitting hole 26*c* formed in the shaft support portion 26B. However, instead, a shaft press-fitting hole can be formed in the shade 32, and the shaft 40 can be press-fitted into and fixed to this shaft press-fitting hole.

In this embodiment described above, although the shade 32 is supported on the holder 26 at the two regions disposed on the pivotal movement axis Ax1, similar operational effects of this embodiment can be obtained even where this support is provided at three or more regions.

The present invention claims priority from Japanese patent application serial no. 2002-057850 filed on Mar. 4, 2002, which is incorporated by reference herein in its entirety.

Several embodiments of the invention have been described herein, but it should be understood that various additions and modifications could be made which fall within the scope of the following claims.

What is claimed is:

1. A vehicle headlamp comprising:

a projector-type lamp unit which comprises:

a light source disposed on an optical axis extending in a forward-rearward direction of a vehicle;

a reflector for forwardly reflecting light from said light source toward said optical axis, a projection lens provided forwardly of said reflector;

a holder provided between said projection lens and said reflector and supporting said projection lens and said reflector;

a shade pivotally supported on said holder to intercept part of reflected light from said reflector; and an actuator for pivotally moving said shade between two predetermined positions at which the light intercepted are respectively different;

wherein the support of said shade on said holder is provided at a plurality of regions disposed on an axis of pivotal movement of said shade; and the support at said plurality of regions is effected through a single shaft extending in a direction of said pivotal movement axis.

2. The vehicle headlamp according to claim 1, wherein said shaft is press-fitted into one of said holder and said shade.

3. The vehicle headlamp according to claim 1, further comprising:

an upstanding wall portion for intercepting part of the direct light from said light source and the reflected light from said reflector, said upstanding wall portion being formed at a portion of said holder disposed forwardly of and near said shade.

4. The vehicle headlamp according to claim 3, further comprising:

projections formed on said upstanding wall portion, wherein said shade abuts against one of the projections when said shade moves into each of said predetermined positions.

5. The vehicle headlamp according to claim 1, wherein the actuator is fixedly supported on the holder.

6. The vehicle headlamp according to claim 1, wherein the light source, the reflector, the projection lens, the shade and the actuator are supported by the holder.

7. The vehicle headlamp according to claim 1, wherein a bushing is press-fitted into a through hole formed through a shaft engagement bracket of the shade.

8. A vehicle headlamp comprising:

a projector-type lamp unit which comprises:

a light source disposed on an optical axis extending in a forward-rearward direction of a vehicle;

a reflector for forwardly reflecting light from said light source toward said optical axis, a projection lens provided forwardly of said reflector;

a holder provided between said projection lens and said reflector and supporting said projection lens and said reflector;

a shade pivotally supported on said holder to intercept part of reflected light from said reflector;

an actuator for pivotally moving said shade; and an upstanding wall portion for intercepting part of the direct light from said light source and the reflected light from said reflector, said upstanding wall portion being formed at a portion of said holder disposed forwardly of and near said shade.

9. The vehicle headlamp according to claim 8, further comprising:

projections formed on said upstanding wall portion, wherein said shade abuts against one of the projections when said shade moves into each of said predetermined positions.

10. A vehicle headlamp comprising:

a projector-type lamp unit which comprises:

a light source disposed on an optical axis extending in a forward-rearward direction of a vehicle;

a reflector for forwardly reflecting light from said light source toward said optical axis, a projection lens provided forwardly of said reflector;

a holder provided between said projection lens and said reflector and supporting said projection lens and said reflector;

a shade pivotally supported on said holder to intercept part of reflected light from said reflector; and an actuator for pivotally moving said shade, wherein the actuator is fixedly supported on the holder.

11. A vehicle headlamp comprising:

a projector-type lamp unit which comprises:

a light source disposed on an optical axis extending in a forward-rearward direction of a vehicle;

a reflector for forwardly reflecting light from said light source toward said optical axis, a projection lens provided forwardly of said reflector;

a holder provided between said projection lens and said reflector and supporting said projection lens and said reflector;

a shade pivotally supported on said holder to intercept part of reflected light from said reflector; and an actuator for pivotally moving said shade, wherein the light source, the reflector, the projection lens, the shade and the actuator are supported by the holder.

* * * * *